US005549171A

United States Patent [19]

Mensa-Wilmot et al.

[11] Patent Number: 5,549,171

[45] Date of Patent: Aug. 27, 1996

[54] DRILL BIT WITH PERFORMANCE-IMPROVING CUTTING STRUCTURE

[75] Inventors: Graham Mensa-Wilmot, Houston; Carl W. Keith, Spring, both of Tex.

[73] Assignee: Smith International, Inc., Houston, Tex.

[21] Appl. No.: 310,862

[22] Filed: Sep. 22, 1994

Related U.S. Application Data

[63] Continuation-in-part of Ser. No. 288,489, Aug. 10, 1994.

[51] Int. Cl.[6] ..... E21B 10/46

[52] U.S. Cl. ..... 175/431; 175/435

[58] Field of Search ..... 175/335, 350, 175/378, 379, 431, 434

[56] References Cited

U.S. PATENT DOCUMENTS

| | | | |
|---|---|---|---|
| Re. 33,757 | 12/1991 | Weaver | 175/329 |
| Re. 34,435 | 11/1993 | Warren et al. | 175/398 |
| 4,429,755 | 2/1984 | Williamson | 175/329 |
| 4,444,281 | 4/1984 | Schumacher et al. | 175/431 X |
| 4,471,845 | 9/1984 | Jürgens | 175/329 |
| 4,475,606 | 10/1984 | Crow | 175/431 |
| 4,512,426 | 4/1985 | Bidegaray | 175/329 |
| 4,545,441 | 10/1985 | Williamson | 175/329 |
| 4,718,505 | 1/1988 | Fuller | 175/329 |
| 4,932,484 | 6/1990 | Warren et al. | 175/329 |
| 4,942,933 | 7/1990 | Barr et al. | 175/329 |
| 5,033,560 | 7/1991 | Sawyer et al. | 175/410 |
| 5,131,478 | 7/1992 | Brett et al. | 175/431 X |
| 5,178,222 | 1/1993 | Jones et al. | 175/431 X |
| 5,186,268 | 2/1993 | Clegg | 175/399 |
| 5,222,566 | 6/1993 | Taylor et al. | 175/431 |
| 5,238,075 | 8/1993 | Keith et al. | 175/431 |
| 5,244,039 | 9/1993 | Newton, Jr. et al. | 175/431 |
| 5,265,685 | 11/1993 | Keith et al. | 175/431 |
| 5,346,025 | 9/1994 | Keith et al. | 175/431 X |
| 5,377,773 | 1/1995 | Tibbits | 175/397 |

*Primary Examiner*—William P. Neuder

*Attorney, Agent, or Firm*—Gregory L. Maag; Conley, Rose & Tayon P.C.

[57] ABSTRACT

A fixed cutter drill bit includes sets of cutter elements mounted on the bit face. Each set includes at least two cutters mounted on different blades at generally the same radial position with reset to the bit axis but having differing degrees of backrake. The cutter elements of a set may be mounted having their cutting faces out-of-profile, such that certain elements in the set are exposed to the formation material to a greater extent than other cutter elements in the same set. The cutter elements in a set may have cutting faces and profiles that are identical, or they may vary in size or shape or both. The bit exhibits increased stability and provides substantial improvement in ROP without requiting excessive WOB.

43 Claims, 6 Drawing Sheets

DRILL BIT WITH PERFORMANCE-IMPROVING CUTTING STRUCTURE

RELATED APPLICATION

This application is a continuation-in-part of U.S. patent application Ser. No. 08/288,489 filed Aug. 10, 1994.

FIELD OF THE INVENTION

This invention relates generally to fixed cutter drill bits of the type typically used in cutting rock formation such as used in drilling an oil well or the like. More particularly, the invention relates to bits utilizing polycrystalline diamond cutting elements that are mounted on the face of the drill bit, such bits typically referred to as "PDC" bits.

BACKGROUND OF THE INVENTION

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downwardly, causing the bit to cut through the formation material by either abrasion, fracturing, or shearing action, or through a combination of all cutting methods. While the bit is rotated, drilling fluid is pumped through the drill string and directed out of the drill bit through nozzles that are positioned in the bit face. The drilling fluid is provided to cool the bit and to flush cuttings away from the cutting structure of the bit. The drilling fluid and cuttings are forced from the bottom of the borehole to the surface through the annulus that is formed between the drill string and the borehole.

Many different types of drill bits and cutting structures for bits have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability. In formations of soft and medium hardness, fixed cutter bits having a PDC cutting structure have been employed with varying degrees of success.

The cost of drilling a borehole is proportional to the length of time it takes to drill the borehole to the desired depth and location. The drilling time, in turn, is greatly affected by the number of times the drill bit must be changed, in order to reach the targeted formation. This is the case because each time the bit is changed the entire drill string—which may be miles long—must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits which will drill faster and longer and which are usable over a wider range of differing formation hardnesses.

The length of time that a drill bit may be employed before the drill string must be tripped to change the bit depends upon the bit's rate of penetration ("ROP"), as well as its durability or ability to maintain a high or acceptable ROP. Additionally, a desirable characteristic of the bit is that it be "stable" and resist vibration, the most severe type or mode of which is "whirl," which is a term used to describe the phenomenon where a drill bit rotates at the bottom of the borehole about a rotational axis that is offset from the geometric center of the drill bit. Such whirling subjects the cutting elements on the bit to increased loading, which causes the premature wearing or destruction of the cutting elements and a loss of penetration rate.

In recent years, the PDC bit has become an industry standard for cutting formations of soft and medium hardnesses. The cutting elements used in such bits are formed of extremely hard materials and include a layer of thermally stable polycrystalline diamond material. In the typical PDC bit, each cutter element or assembly comprises an elongate and generally cylindrical support member which is received and secured in a pocket formed in the surface of the bit body. A disk or tablet-shaped, preformed cutting element having a thin, hard cutting layer of polycrystalline diamond is bonded to the exposed end of the support member, which is typically formed of tungsten carbide. Although such cutter elements historically were round in cross section and included a disk shaped PDC layer forming the cutting face of the element, improvements in manufacturing techniques have made it possible to provide cutter elements having PDC layers formed in other shapes as well.

As PDC bits were being developed for use in harder formations, their cutting structures were typically designed so as to be "heavy set," which means that the bit was provided with a large number of cutter elements distributed about the face of the bit such that each of the elements would remove a comparatively small amount of material from the formation during each revolution, and would be subjected to a loading that was less than the loading that would be experienced by the cutter element if fewer cutter elements were provided. This arrangement is to be contrasted with a "light set" bit which had proven successful in softer formations and which has a comparatively fewer number but larger sized cutter elements, each of which would remove a greater volume of formation material than the elements used in a "heavy set" bit.

Because of the difference in design and construction of the heavy set and light set PDC bits, inefficiencies resulted when using one of these bit designs to drill through formations of differing hardness. For example, if a heavy set bit was used for the reason that a lower formation layer had a relatively high degree of hardness compared to a softer upper layer, the heavy set bit tended to clog in the softer formations, resulting in a reduced ROP in that section of the borehole. Alternatively, if a light set bit was used, the ROP in the hard formation was relatively slow in comparison to the rate that could be achieved using a heavy set bit. Thus, where PDC bits were to be used, it was frequently necessary to accept lower ROP's while drilling through formations of one degree of hardness or another, or to trip the drill string and change the drill bits when drilling through formations of differing hardness. Either of these alternatives could be extremely costly.

A common arrangement of the PDC cutting elements was at one time to place them in a spiral configuration. More specifically, the cutter elements were placed at selected radial positions with respect to the central axis of the bit, with each element being placed at a slightly more remote radial position than the preceding element. So positioned, the path of all but the center-most elements partly overlapped the path of movement of a preceding cutter element as the bit was rotated. Thus, each element would remove a lesser volume of material than would be the case if it were radially positioned so that no overlapping occurred, or occurred to a lesser extent, because the leading cutter element would already have removed some formation material from the path traveled by the following cutter element. Using this arrangement of cutters, each cutter tended to remove a comparatively small amount of material from the formation during each revolution, and was subjected to substantially the same loading as the other cutter elements on the bit face.

Although the spiral arrangement was once widely employed, this arrangement of cutter elements was found to wear in a manner to cause the bit to assume a cutting profile that presented a relatively flat and single continuous cutting edge from one element to the next. Not only did this decrease the ROP that the bit could provide, it but also increased the likelihood of bit vibration. Both of these conditions are undesirable. A low ROP increases drilling time and cost, and may necessitate a costly trip of the drill string in order to replace the dull bit with a new bit. Excessive bit vibration will itself dull the bit or may damage the bit to an extent that a premature trip of the drill string becomes necessary.

Thus, in addition to providing a bit capable of drilling effectively at desirable ROP's through a variety of formation hardnesses, preventing bit vibration and maintaining stability of PDC bits has long been a desirable goal, but one which has not always been achieved. Bit vibration typically may occur in any type of formation, but is most detrimental in the harder formations. As described above, the cutter elements in many prior art PDC bits were positioned in a spiral relationship which, as drilling progressed, wore in a manner which caused the ROP to decrease and which also increased the likelihood of bit vibration.

There have been a number of designs proposed for PDC cutting structures that were meant to provide a PDC bit capable of drilling through a variety of formation hardnesses at effective ROP's and with acceptable bit life or durability. For example, U.S. Pat. No. 5,033,560 (Sawyer et at.) describes a PDC bit having mixed sizes of PDC cutter elements which were arranged in an attempt to provide improved ROP while maintaining bit durability. The '560 patent is silent as to the ability of the bit to resist vibration and remain stable. Similarly, U.S. Pat. No. 5,222,566 (Taylor et at.) describes a drill bit which employs PDC cutter elements of differing sizes, with the larger size elements employed in a first group of cutters and the smaller size employed in a second group, the patent describing such a bit as tending to act as a "heavy set" bit in certain formations and as a "light set" bit in other softer formations. This design, however, suffers from the fact that the cutter elements do not share the cutting load equally. Instead, the blade on which the larger sized cutters are grouped is loaded to a greater degree than the blade with the smaller cutter elements. This could lead to blade failure. U.S. Pat. No. Re 33,757 (Weaver) describes still another cutting structure having a first row of relatively sharp, closely-spaced cutter elements, and a following row of widely-spaced, blunt or rounded cutter elements for dislodging the formation material between the kerfs or grooves that are formed by the sharp cutters. While this design was intended to enhance drilling performance, the bit includes no features directed toward stabilizing the bit once wear has commenced. Further, the bit's cutting structure has been found to limit the bit's application to relatively brittle formations.

Separately, other attempts have been made at solving bit vibration and increasing stability. For example, U.S. Pat. No. RE 34,435 (Warren et al.) describes a bit intended to resist vibration that includes a set of cutters which are disposed at an equal radius from the center of the bit and which extend further from the bit face than the other cutters on the bit. According to that patent, the set of cutters extending furthest from the bit face are provided so as to cut a groove within the formation. By design, the extending cutters ride in the groove which tends to stabilize the bit. Similarly, U.S. Pat. No. 5,265,685 (Keith et al.) discloses a PDC bit that is designed to cut a series of grooves in the formation such that the resulting ridges formed between each of the concentric grooves tends to stabilize the bit. U.S. Pat. RE 34,435 and 5,265,685 both disclose using the same sized cutter elements. U.S. Pat. No. 5,238,075 (Keith et al.) also describes a PDC bit having a cutter element arrangement which employs cutter elements of different sizes and which, in part, was hoped to provide greater stabilization.

Unfortunately, however, many of the bit designs aimed at minimizing vibration require that drilling be conducted with an increased weight-on-bit (WOB) as compared with bits of earlier designs. Certain other bits also require substantial additional WOB in order to drill effectively. For example, some bits have been designed with cutters mounted at less aggressive backrake angles such that they require increased WOB in order to penetrate the formation material to the desired extent. Drilling with an increased or heavy WOB has serious consequences and is avoided whenever possible. Increasing the WOB is accomplished by adding additional heavy drill collars to the drill string. This additional weight increases the stress and strain on all drill string components, causes stabilizers to wear more and to work less efficiently, and increases the hydraulic pressure drop in the drill string, requiring the use of higher capacity (and typically higher cost) pumps for circulating the drilling fluid. Compounding the problem still further, the increased WOB causes the bit to wear and become dull much more quickly than would otherwise occur. In order to postpone tripping the drill string, it is common practice to add still additional WOB and to continue drilling with the partially worn and dull bit. The relationship between bit wear and WOB is not linear, but is an exponential one, such that upon exceeding a particular WOB for a given bit, a very small increase in WOB will cause a tremendous increase in bit wear. Thus, adding more WOB so as to drill with a partially worn bit further escalates the wear on the bit and other drill string components.

Thus, despite attempts and certain advances made in the art, there remains a need for a fixed cutter bit having an improved cutter arrangement which will permit the bit to drill effectively at economical ROP's and, ideally, to drill in formations having a hardness greater than that in which conventional PDC bits can be employed. More specifically, there is a need for a PDC bit which can drill in soft, medium, medium hard and even in some hard formations while maintaining an aggressive cutter profile so as to maintain acceptable ROP's for acceptable lengths of time and thereby lower the drilling costs presently experienced in the industry. Such a bit should also provide an increased measure of stability as wear occurs on the cutting structure of the bit so as to resist bit vibration. Ideally, the increased stability of the bit should be achieved without having to employ substantial additional WOB and suffering from the costly consequences which arise from drilling with such extra weight.

SUMMARY OF THE INVENTION

Accordingly, there is provided herein a drill bit particularly suited for drilling through a variety of formation hardnesses with normal WOB at improved penetration rates while maintaining stability and resisting bit vibration. The bit has the characteristics of a light set bit when drilling is initiated and, after some wear has occurred, takes on the characteristics of a heavy set bit, as desirable for drilling through harder formations. The bit may be successfully employed in formations of greater hardness than can typically be drilled using conventional PDC bits.

The bit generally includes a bit body and a cutting face which includes a plurality of sets of cutter elements mounted on the bit face. The cutter elements in a set are mounted on the bit face at generally common radial positions relative to the bit axis, such that the elements in a set tend to follow the same circular path. Each set may consist of two, three or more cutter elements. The elements in a set are mounted so as to have differing or varying amounts of backrake. The backrake angles of the cutter elements in a set will typically vary between approximately 10° and 30° negative backrake.

The cutter elements may be disposed about the bit face in radially extending rows on angularly spaced blades of the bit. The cutter elements having a greater backrake angle may all be positioned on a first blade, with the cutters having less backrake trailing behind it on a second blade angularly displaced from the first. Alternatively, the blades may each include the cutter elements having the greater and lesser amounts of backrake, and may be disposed in a repeating pattern along the blade so that the blades will be more equally loaded. A particularly desirable pattern is to alternate the cutter elements of greater and lesser amounts of backrake along the cutting profile of each blade.

The cutter elements in each set may all have cutting faces having the same general shape, or they may have various shapes. For example, the cutters in a set may all be generally circular, or all pointed, or a combination of each type. The cutting faces of the elements in a set may also differ in size. Additionally, the cutter elements in the set may have differing exposure heights, such that those elements extending further from the bit face are more exposed to the formation material than those which are mounted at a relatively lower height from the bit face. In this configuration, the less exposed cutter elements in a set are partially hidden from the formation material until a certain degree of bit wear occurs on the more exposed cutter elements. Given this relationship, the bit will initially drill as a light set bit. As drilling progresses, the more exposed cutter elements in a set will gradually wear until the bit takes on the characteristics of a heavy set bit as is useful for drilling in the harder formations. In certain embodiments, the most exposed cutter elements will have smaller negative backrake angles than those elements that are less exposed. In other embodiments designed for different formation material and hardnesses, the more exposed cutters will have a greater negative backrake angle than the lesser exposed cutters.

In embodiments of the invention employing sets of cutters with varying sized cutter faces, the cutter having the smallest cutting face will generally be mounted so as to have the greatest exposure to the formation, while the cutter having the largest cutting face will have the least exposure to the formation. This arrangement increases the stability of the bit by creating relatively tall and sharply tapered ridges between the kerfs which provide the side forces helpful in resisting bit vibration. The most exposed cutters in a set may either have more or less negative backrake relative to the other cutters in the same set as dependent upon the type of formation being cut.

Thus, the present invention comprises a combination of features and advantages which enable it to substantially advance the drill bit art by providing apparatus for effectively and efficiently drilling through a variety of formation hardnesses at economic rates of penetration and with superior bit durability. The bit drills with less vibration and greater stability, even after substantial wear has occurred to the cutting structure of the bit. Further, drilling with the bit does not also require additional or excessive WOB, permitting drilling to proceed more economically than with many prior art PDC bits. These and various other characteristics and advantages of the present invention will be readily apparent to those skilled in the art upon reading the following detailed description of the preferred embodiments of the invention, and by referring to the accompanying drawings.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

Figure 1:
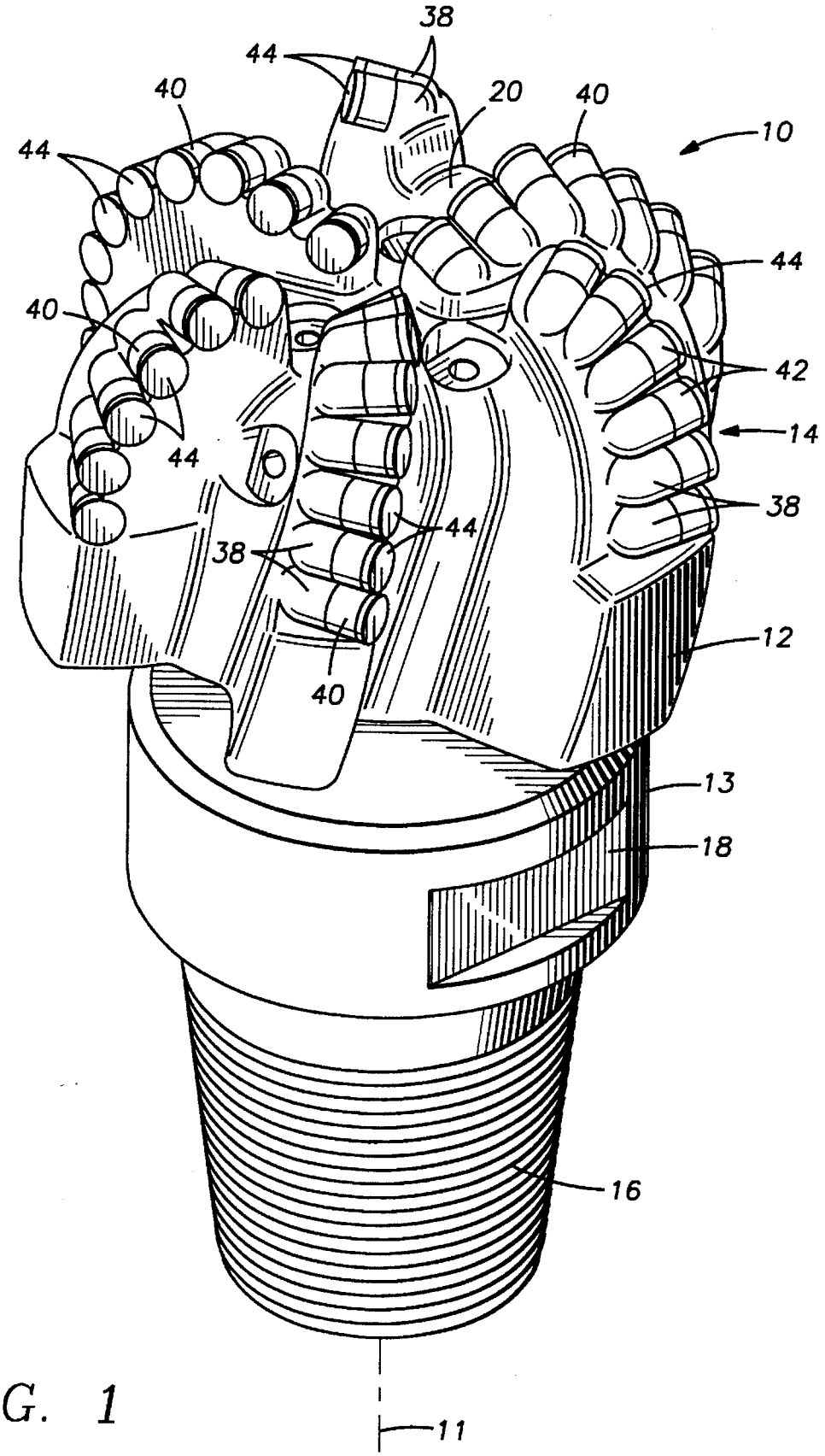
FIG. 1 is a perspective view of a drill bit made in accordance with the present invention.
Figure 2:
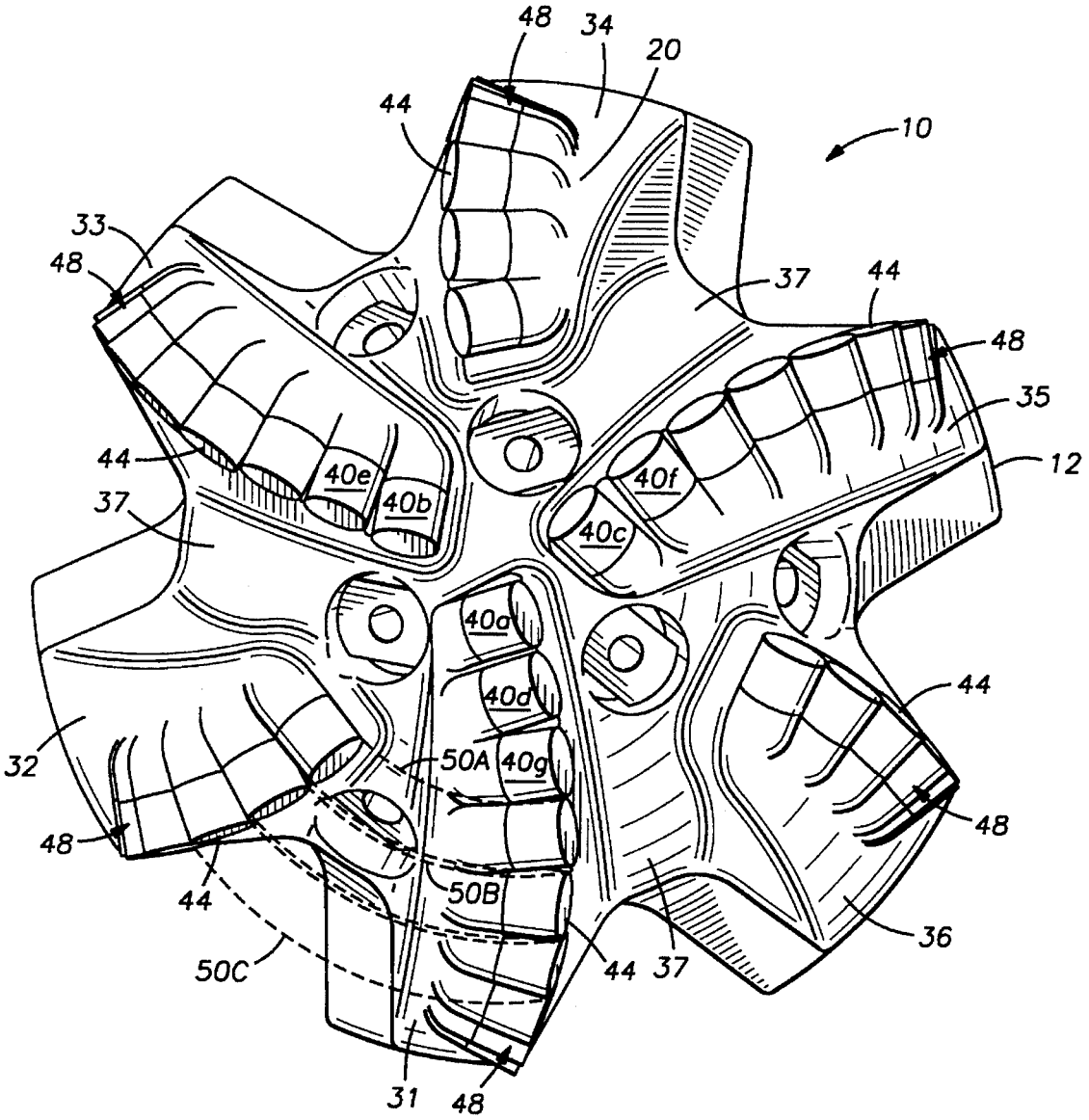
FIG. 2 is a plan view of the cutting end of the drill bit shown in FIG. 1.
Figure 3:
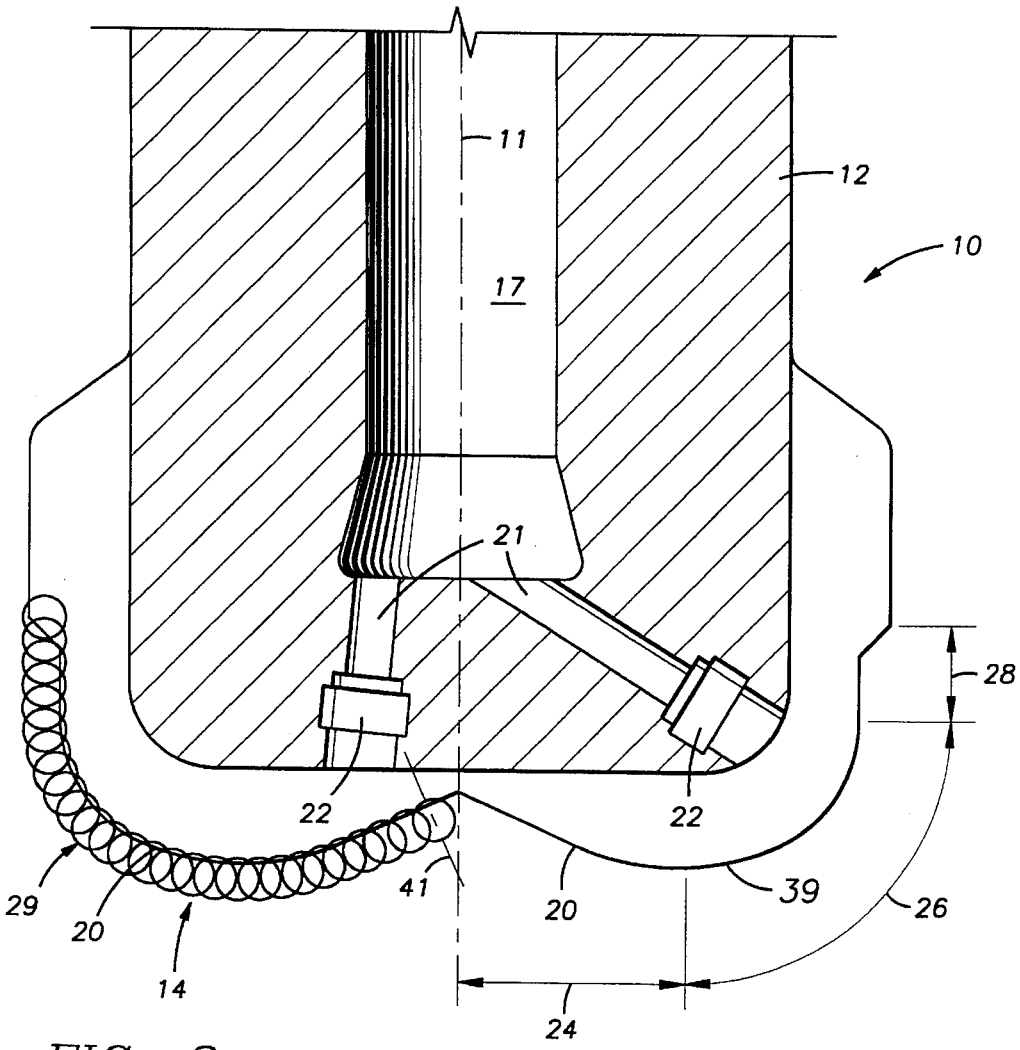
FIG. 3 is an elevational view, partly in cross-section, of the drill bit shown in FIG. 1 with the cutter elements shown in rotated profile collectively on one side of the central axis of the drill bit.

A drill bit 10 embodying the features of the present invention is shown in FIGS. 1–3. Bit 10 is a fixed cutter bit, sometimes referred to as a drag bit, and is adapted for drilling through formations of rock to form a borehole. Bit 10 generally includes a central axis 11, a bit body 12, shank 13, and threaded connection or pin 16 for connecting bit 10 to a drill string (not shown) which is employed to rotate the bit for drilling the borehole. Bit 10 further includes a PDC cutting structure 14 having a plurality of cutter elements 40 described in more detail below.

Body 12 includes a central longitudinal bore 17 (FIG. 3) for permitting drilling fluid to flow from the drill string into the bit. A pair of oppositely positioned wrench flats 18 (one shown in FIG. 1) are formed on the shank 13 and are adapted for fitting a wrench to the bit to apply torque when connecting and disconnecting bit 10 from the drill string.

Bit body 12 includes a bit face 20 which is formed on the end of the bit 10 that is opposite pin 16 and which supports cutting structure 14. Body 12 is formed in a conventional manner using powdered metal tungsten carbide particles in a binder material to form a hard metal cast matrix. Steel bodied bits, those machined from a steel block rather than a formed matrix, may also be employed in the invention. In the preferred embodiment shown, bit face 20 includes six angularly spaced-apart blades 31–36 which are integrally formed as part of and which extend from body 12. Blades 31–36 extend radially across the bit face 20 and longitudinally along a portion of the periphery of the bit. Blades 31–36 are separated by grooves which define drilling fluid flow courses 37 between and along the cutter elements 40 which are mounted on the blades 31–36 of bit face 20. Again in the preferred embodiment shown in FIG. 2, blades 31, 33 and 35 are equally spaced 120° apart, while blades 32, 34 and 36 lag behind blades 31, 33 and 35 by 55°. Given this angular spacing, blades 31–36 may be considered to be divided into pairs of "leading" and "lagging" blades, a first such pair comprising blades 31 and 32, a second pair comprising blades 33 and 34, and a third pair including blades 35 and 36.

As best shown in FIG. 3, bit body 12 is also provided with downwardly extending flow passages 21 having nozzles 22 disposed at their lowermost ends. In the preferred embodiment shown, bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Referring now to FIG. 3, to aid in an understanding of the more detailed description which follows, bit face 20 may be said to be divided into three different zones or regions 24, 26, 28. The central portion of the bit face 20 is identified by the reference numeral 24 and may be concave as shown. Adjacent central portion 24 is the shoulder or the upturned curved portion 26 which leads to the gage portion 28. Gage portion 28 is the portion of the bit face 20 which defines the diameter or gage of the borehole drilled by bit 10. As will be understood by those skilled in the art, regions 24, 26, 28 are approximate and are identified only for the purposes of better describing the distribution of cutter elements 40 over the bit face 20, as well as other inventive features of the present invention.

As best shown in FIG. 1, each cutter element 40 is mounted within a pocket 38 which is formed in the bit face 20 on one of the radially and longitudinally extending blades 31–36. Cutter elements 40 are constructed by conventional methods and each typically includes a cylindrical base or support 42 having one end secured within a pocket 38 by brazing or similar means. The support 42 is comprised of a sintered tungsten carbide material having a hardness greater than that of the body matrix material. Attached to the opposite end of the support 42 is a layer of extremely hard material, preferably a synthetic polycrystalline diamond material which forms the cutting face 44 of element 40. Such cutter elements 40, generally known as polycrystalline diamond composite compacts, or PDC's, are commercially available from a number of suppliers including, for example, Smith Sii Megadiamond, Inc. or General Electric Company, which markets compacts under the trademark STRATAPAX. Although cutters 40 have thus far been shown and described as generally cylindrical elements, the bit 10 and cutting structure 14 of the present invention is not limited to any particular type of cutter element, and stud cutters having cutting faces mounted on posts that are typically fixed normal to the bit face may also be employed.

As shown in FIGS. 1 and 2, the cutter elements 40 are arranged in separate rows 48 along the profiles of blades 31–36 and are positioned along the bit face 20 in the regions previously described as the central portion 24, shoulder 26 and gage portion 28. The cutting faces 44 of the cutter elements 40 are oriented in the direction of rotation of the drill bit 10 so that the cutting face 44 of each cutter element 40 engages the earth formation as the bit 10 is rotated and forced downwardly through the formation. Referring momentarily to FIG. 3, each of the cutters 40 is positioned with an element mounting axis 41 (one shown in FIG. 3) extending normal to the profile 39 of blades 31–36 which comprise a portion of bit face 20.

Figure 4:
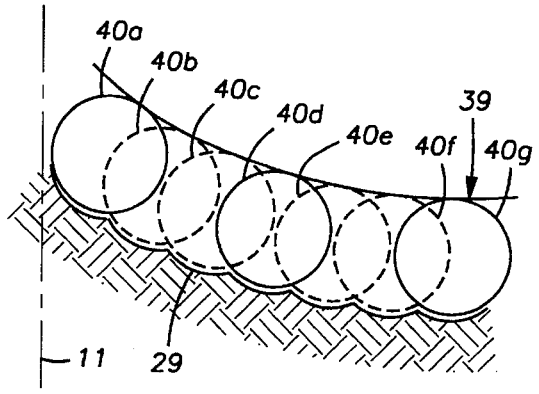
FIG. 4 is an enlarged view of a portion of FIG. 3 showing the overlapping of the cutting profiles of the cutter elements located adjacent to the bit axis.

Referring again to FIGS. 2 and 3, each row 48 includes a number of cutter elements 40 that are radially spaced from each other relative to the bit axis 11 and positioned in predetermined radial positions on blades 31–36. As is well known in the art, cutter elements 40 are radially spaced such that the groove or kerf formed by the cutting profile of a cutter element 40 overlaps to a degree with kerfs formed by one or more cutter elements 40 of other rows 48. Such overlap is best understood by referring to FIG. 4 which schematically shows, in rotated profile, the relative radial positions of the most centrally located cutter elements 40, that is, those elements 40 positioned closest to bit axis 11 which have been identified in FIGS. 2 and 4 with the reference characters **40*a*–40*g*. As shown, elements 40*a*, 40*d* and 40*g* are radially spaced in a first row 48 on blade 31. As bit 10 is rotated, these elements will cut separate kerfs in the formation material, leaving ridges therebetween. As the bit 10 continues to rotate, cutter elements 40*b* and 40*c*, mounted on blades 33 and 35, respectively, will cut the ridge that is left between the kerfs made by cutter elements 40*a* and 40*d*. Likewise, elements 40*e* and 40*f* (also on blades 33 and 35, respectively) cut the ridge between the kerfs formed by elements 40*d* and 40*g*. With this radial overlap of cutter 40 profiles, the cutting profile of cutting structure 14 may be generally represented by the relatively smooth curve 29 formed by the outermost edges of cutting faces 44 of cutters 40 shown in FIG. 3, which shows the cutter elements 40 of the bit 10 in rotated profile collectively on one side of central bit axis 11**.

As will be understood from the disclosure which follows, certain cutter elements 40 are positioned on blades 31–36 at generally the same radial position as other elements 40 and therefore follow in the swath of kerf cut by a preceding cutter element 40. When such "following" elements also have substantially the same exposure height or degree of exposure to the earth formation being drilled, these elements may be referred to as "redundant" cutters. In the rotated profile of FIG. 3, the distinction between such redundant cutter elements cannot be seen. Likewise, where cutter elements 40 that are disposed in generally the same radial position are mounted at different exposure heights, or are mounted so as to have varying degrees of backrake, these relatively small differences in exposure height and backrake are not visible in FIG. 3, but are described below in more detail with reference to FIGS. 6–12.

Figure 5:
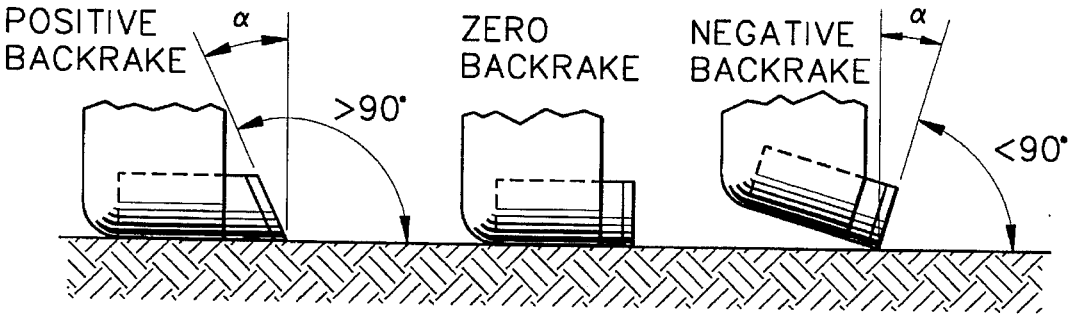
FIG. 5 is a schematic view showing cutter elements engaging formation material at various degrees of backrake.

In accordance with the invention, elements 40 are mounted such that their cutting faces 44 engage the formation material with varying degrees of "backrake." Referring momentarily to FIG. 5, three cutters 40 having cutting faces 44 are shown mounted on a bit with different backrake angles. Backrake may generally be defined as the angle $\alpha$ formed between the cutting face of the cutter element 40 and a line that is normal to the formation material being cut. As shown, with a cutter element having zero backrake, the cutting face 44 is substantially perpendicular or normal to the formation material. A cutter having a negative backrake angle $\alpha$ has a cutting face that engages the formation material at an angle that is less than 90° as measured from the formation material. Similarly, a cutter element 40 having a positive backrake angle $\alpha$ has a cutting face which engages the formation material at an angle that is greater than 90° when measured from the formation material as depicted in FIG. 5.

In addition to being mounted in rows 48, cutter elements 40 are also arranged in groups or sets 50. Each cutter set 50 includes cutter elements 40 from various rows 48. The cutter elements 40 in a set 50 generally have the same radial position with respect to bit axis 11 but are mounted with varying amounts of backrake. Cutter element sets 50 may include two, three or any greater number of cutter elements 40. For illustrative purposes, three of such sets 50A–C, each having two cutter elements 40, are generally shown enclosed by dashed lines in FIG. 2.

Figure 6:
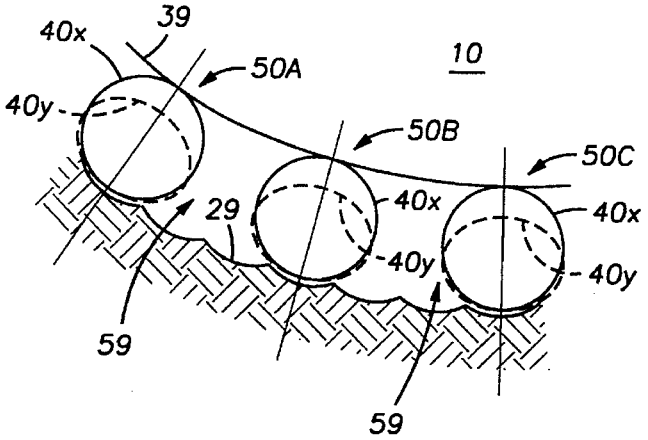
FIG. 6 is an enlarged view similar to FIG. 4 showing schematically, in rotated profile, the relative radial positions and cutting profiles of various sets of cutter elements that are mounted on the drill bit shown in FIG. 1.

Referring now to FIG. 6, cutter element sets 50A–C are shown in rotated profile in relation to bit axis 11. The cutter elements 40 of each set 50A–C include round cutting faces 44 of substantially equal diameters and are mounted on bit face 20 with their element axes 41 aligned and normal to the profile of the respective blade on which the elements are mounted. Because the bit face 20 is curved in profile, and because the axes 41 of elements 40 are aligned and normal to the blade profile of bit face 20, cutters 40 in a set 50 do not have precisely the same radial position with respect to bit axis 11, except where the elements in a set are positioned at a location where their aligned axes 41 are parallel to the bit axis 11. Nevertheless, because the elements 40 in each set 50 cut in the same circular path, the elements may fairly be said to have a common or substantially the same radial position relative to the bit axis.

As previously mentioned, the cutter elements 40 within a set 50 are mounted so as to have varying degrees of backrake. More specifically, in the embodiment shown in FIG. 6, cutter elements 40*x*, which are shown mounted on blade profile 39 of blade 31, have a negative backrake angle of substantially 10°. Cutter elements 40*y*, which are shown mounted on profile 39 of the angularly spaced blade 32, have a negative backrake angle of substantially 30°. As depicted in FIG. 6, the cutting profile of elements 40*x* are substantially circular given their very slight degree of backrake. By contrast, the cutting profile of elements of 40*y*, which have a greater degree of negative backrake appear more elliptical. In this arrangement, cutter elements 40*x* on leading blade 31 are said to have a more aggressive backrake angle as compared with the cutter elements 40*y* on lagging blade 32. Although not shown in FIG. 6, it will be understood from the disclosure relating to FIGS. 3 and 4 that additional sets 50 of cutters 40 will be positioned on bit face 20 at radial positions between sets 50A and 50B and between sets 50B and 50C so as to cut the formation material in the regions generally identified by reference numeral 59. These additional cutter sets, which would be mounted on blades 33–36 in this example, are not shown in FIG. 6 for the sake of clarity.

Also, although this embodiment of the invention is shown in FIGS. 1, 2 and 6 on a six-bladed bit 10, the principles of the present invention can be employed in bits having any number of blades, and the invention is not limited to a bit having any particular number of blades or angular spacing of the blades. Furthermore, although sets 50A–C are shown in FIGS. 2 and 6 as including only two cutter elements 40, the invention preferably includes a greater number of elements in sets 50. Referring generally to FIG. 6, each of the sets 50A–C may include several cutter elements having the same cutting profile as that of cutter 40*x*, and several others having the same cutting profile as that of cutter element 40*y*. For example, a cutting structure 14 on bit face 20 may include a cutter set 50A having three cutter elements 40 mounted with 10° of backrake such that, in rotated profile, all three such elements 40 would have the same cutting profile as the element designated as 40*x*. These three elements having the cutting profile of 40*x* shown in FIG. 6 may be separately mounted on blades 31, 33 and 35 (FIG. 2). This same set 50A may simultaneously include three cutter elements 40 mounted with the same 30° backrake such that, in rotated profile, they will have the same cutting profile as that element shown as 40*y*. The cutters having the profile of 40*y* could be individually mounted on blades 32, 34 and 36.

An arrangement as thus described having a cutting structure 14 with sets 50 having three redundant aggressive cutters 40*x* and three redundant cutters 40*y* mounted at a less aggressive backrake angle has particular benefits and advantages over prior art bits. The cutting structure will permit the bit to drill effectively in a variety of formation hardnesses at high ROP's, both when the bit is new and as wear occurs. Further, providing a plurality of cutter elements 40 in sets 50 at substantially the same radial position and positioning these sets across the bit face 20 will provide a stabilizing effect to the bit without the need for additional WOB.

Although cutter elements 40*x* and 40*y* have thus far been described as being segregated by blade, another alternative embodiment of the invention provides that various of the elements 40*x* and 40*y* will be mounted on the same blade in any of a variety of repetitive patterns. This arrangement has the advantage of equalizing the loading on the blades and is described in more detail with reference to various of the alternative embodiments described below. In describing all of the following alternative embodiments, similar reference numerals and characters will be used to identify like or common elements.

Figure 7:
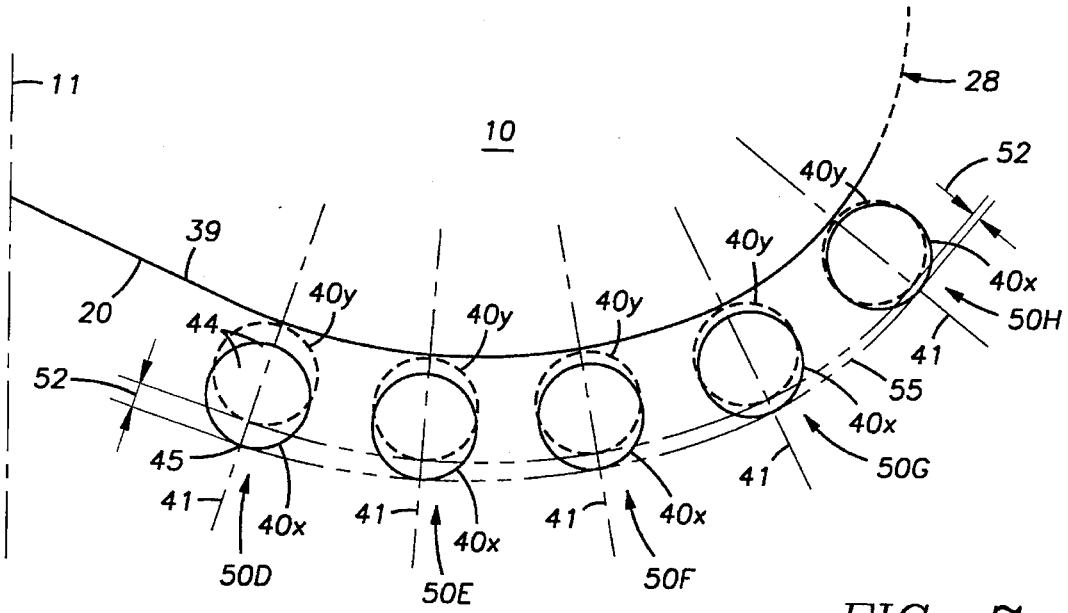
FIG. 7 is a view similar to FIG. 6 showing an alternative embodiment of the present invention which includes cutter elements having varying exposure heights.

One such alternative embodiment of the present invention is shown in FIG. 7. In this embodiment, sets 50D–H include cutter elements having varying exposure heights relative to the formation material, in addition to having varying degrees of backrake. As shown, cutter sets 50D–H are mounted spaced-apart along the blade profile 39 of bit face 20. Cutter elements represented as 40*x* are mounted on blades 31, 33 and 35 at backrake angles of approximately 10°. Elements 40*y* are mounted at greater backrake angles equal to substantially 30° and are mounted on blades 32, 34 and 36. Due to their respective backrake angles, the cutting profile of cutter elements 40x are substantially circular, while the profiles of 40y are more elliptical.

As shown, cutter elements 40x in each set 50D–H is mounted such that its cutting face 44 is exposed to the formation material engaged by the bit to a greater extent than the cutter elements 40y of the same set 50. Thus, the elements 40x will, at least initially before significant wear occurs, cut deeper swaths or kerfs in the formation material than the less exposed elements 40y of the set. This difference in exposure height of elements 40x and 40y, measured between the edges of their respective cutting faces 44, can be described as an exposure variance and is identified by reference numeral 52. As shown in the embodiment of FIG. 7, the exposure variance 52 preferably decreases with each radially spaced set 50 upon moving from axis 11 toward the gage portion 28 of bit face 20. As an example, the exposure variance 52 between cutter elements 40x and 40y of set 50D located in the central portion 24 of bit face 20 is preferably about 0.060 inches. For cutter set 50H that is disposed at a location on the shoulder portion 26 of bit face 20, adjacent to gage portion 28, the exposure variance may be only 0.030 inches.

Referring still to FIGS. 2 and 7, as the bit 10 is rotated about its axis 11, the blades 31–36 sweep around the bottom of the borehole causing elements 40x and 40y to each cut a trough or kerf within the formation material. As is apparent, the depth of the kerf formed by each cutter element 40 is dependant upon the extent to which the element 40 extends from cutting face 20 of bit 10. Because elements 40x have a greater exposure height, they will tend to cut deeper kerfs than the cutters 40y of the same set which follow in the kerfs cut by the corresponding elements 40x. Because elements 40y are not exposed to the same extent to the formation as elements 40x, they are not called upon to cut as great a volume of formation material as do the more exposed elements 40x. In this regard, elements 40y may be considered partially "hidden" from the formation by elements 40x.

As shown in FIG. 7, cutter sets 50D–H are radially spaced from one another such that ridges will be formed as sets 50 cut kerfs in the formation when the bit 10 is rotated. In a similar manner to that described previously with reference to FIGS. 4 and 6, other sets 50 of cutter elements 40 that are mounted on blades 33–36 will follow behind cutter sets 50D–E in a radially overlapping fashion so as to cut the ridges between sets 50D–E and yield a relatively smooth bit cutting profile 55.

When bit 10 having the cutter arrangement shown in FIG. 7 is first placed in the borehole, it has the characteristics of a light set bit. This is because the elements 40y are at least partially hidden from the formation and initially perform very little cutting relative to that performed by the more exposed cutter elements 40x. As bit 10 is rotated, it is also forced downwardly against the formation material with great force. In relatively soft formations, bit 10 will drill hole with very little wear being experienced by any of the cutter elements 40. Favorable ROP's are maintained, in part due to the aggressive backrake angles of elements 40x which, which to this point are supporting most of the cutting load. As the formation material penetrated by the bit 10 becomes harder, however, elements 40x will begin to wear. As drilling continues, elements 40x will eventually wear to the extent that elements 40y are no longer hidden, such that elements 40x and 40y will begin to cut substantially equal volumes of formation and will be subjected to substantially equal loading. At this point, the bit 10 has the characteristics of a heavy set bit as is desirable for cutting in harder formations. Also, providing elements 40x, 40y with differing degrees of backrake within the same sets 50, along with the fact that the sets 50, in this state of wear, include some sharp and some dull cutter elements 40, synergistically combine to reduce vibration and increase bit stability. This arrangement of cutter elements 40 at generally the same radial position but at varying degrees of backrake and exposure height is believed to be particularly advantageous for use in drilling intervals of different formations and strength.

Figure 8:
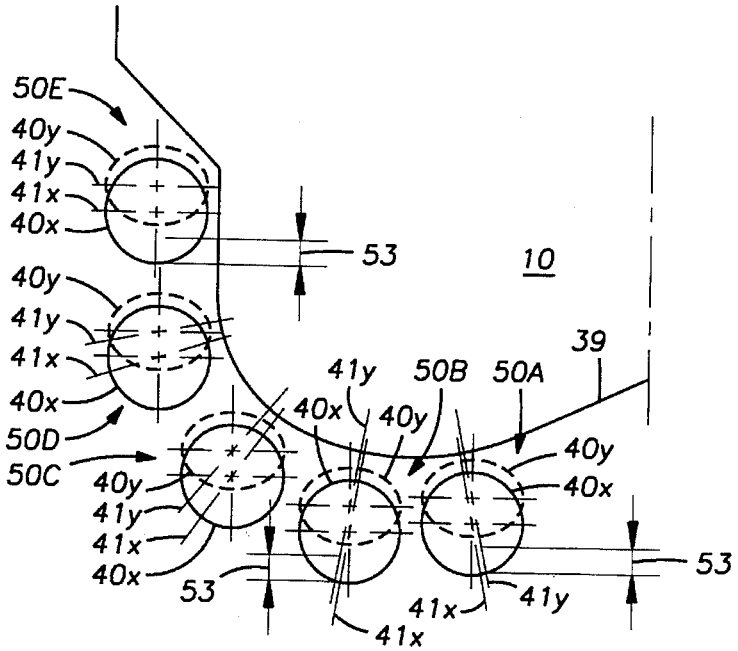
FIGS. 8–12 are views similar to FIGS. 6 and 7 showing still further alternative embodiments of the present invention.

Referring now to FIG. 8, an alternative embodiment of the invention similar to that of FIG. 7 is shown in which the cutter elements 40 of sets 50 are offset or displaced from one another in a direction that is substantially parallel to bit axis 11. As shown, bit 10 again includes cutter element sets 50D–H. The cutter elements 40 include circular cutting faces 44 of substantially equal diameters. Elements 40x are mounted with backrake angles of substantially 10° to again have aggressive cutting profiles. Elements 40y are mounted such that their backrake angles are substantially 30°. Due to the differing degrees of backrake, the cutting profiles of elements 40y will thus again appear more elliptical than the cutting profiles of elements 40x. The cutter elements 40 are mounted on bit face 20 such that the centers 49 of each cutting face 44 in a set 50 are equidistant from bit axis 11. Accordingly, cutter elements 40x and 40y of each set 50 are positioned at the same radial position with respect to bit axis 11; however, their element mounting axes, 41x and 41y respectively, although normal to bit face 20, are not aligned with each other as in the embodiment previously described and shown in FIG. 7. Thus, in the arrangement shown in FIG. 8, each set 50 includes at least one element 40x that is mounted on bit face 20 such that its cutting face 44, in rotated profile, is offset from the cutting profile of elements 40y of the same set 50 by an exposure variance designated by the reference numeral 53. In this embodiment, the exposure variance 53 of cutter sets 50D–H will all be identical, and may be, for example, approximately 0.060 inches.

Figure 9:
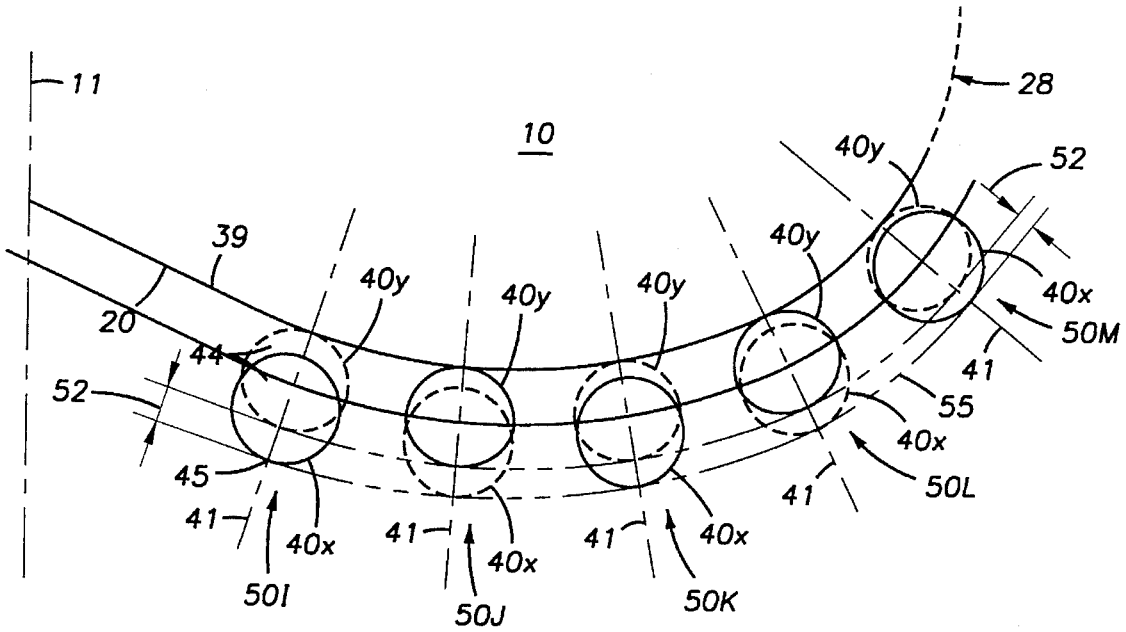

Another alternative embodiment of the invention is shown in FIG. 9 where bit 10 is shown to include five cutter sets 50I–M mounted on the profiles 39 of blades 31–36 on bit face 20 in radially-spaced relationship relative to bit axis 11. Each cutter set 50 includes a pair of cutter elements 40 having generally the same radial position and having circular cutting faces 44 of substantially the same diameter. Each cutter set 50 includes an element 40x that is exposed to a greater degree to the formation than the other element 40y. Elements 40x and 40y are mounted on bit face 20 with their element axes 41 aligned and normal to face 20. As with the embodiments shown in FIGS. 6–8, elements 40x are mounted so as to have a backrake angle of approximately 10°, while elements 40y have backrake angles of substantially 30°. In this embodiment, however, blades 31–36 include both types of elements 40x and 40y mounted in alternating fashion along the blade's radial length. More specifically, a first blade, for example, blade 31 (FIG. 2) is shown to include a row 48 of radially-spaced cutter elements 40 mounted so as to have the cutting profiles shown in FIG. 9 by the cutting faces 44 depicted with the solid lines. A second blade, such as blade 32 (FIG. 2) will follow behind blade 31 and will have a row of cutter elements spaced so as to have the cutter profile shown by the cutting faces 44 represented by the dashed lines. As with the embodiment shown in FIG. 7, the exposure variance 52 between the cutting faces 44 of elements 40x and 40y decreases across the cutting profile of bit 10 upon moving from axis 11 toward gage portion 28 of bit face 20. Also as previously described, sets 50I–M may include a number of cutters that are redundant to the cutters represented by cutting profiles 40x and 40y.

Like the embodiment shown and described with reference to FIG. 7, the bit 10 of FIG. 9 initially has the characteristics of a light set bit given that one half of the total number of cutter elements (elements 40y) are partially hidden by the more exposed cutters 40x until the formation wears the more exposed and more aggressive (less backrake) elements 40x. After substantial wear occurs, the bit 10 assumes the characteristic of a heavy set bit where all cutter elements 40x and 40y cut substantially equal volumes and generally share the loading equally. The alternating pattern of elements 40x and 40y along rows 48 on blades 31–36 enable each blade 31–36 to share the load equally through out the drilling process. Thus, the embodiment of FIG. 9 has the additional advantage that the blades 31–36 are all substantially evenly loaded such that one blade is not required to endure most of the loading until cutter elements 40x wear, as is the case with the bit 10 described with reference to FIG. 7.

Substantially the same equal loading on blades 31–36 can be achieved through other alternating patterns of elements 40x (highly exposed, less backrake) and 40y (less exposed, more backrake). For example, beginning at a particular radial position and moving outwardly toward the gage portion 28 of the bit face 20, a blade 31 may include a row 48 of radially-spaced cutters 40 having the following pattern: 40x, 40x, 40y, 40y, 40x, 40x. In this example, the following blade 32 would then be provided with a corresponding row 48 having cutter elements positioned at substantially the same radial position as the cutters just described for blade 31 and in the following cutter pattern: 40y, 40y, 40x, 40x, 40y, 40y. As will be appreciated by those skilled in the art, a number of other similar patterns can also be employed. Also, it should be understood that in certain formations, it may be more desirable to mount the cutter elements that are more exposed with less backrake than the lesser exposed elements.

Figure 10:
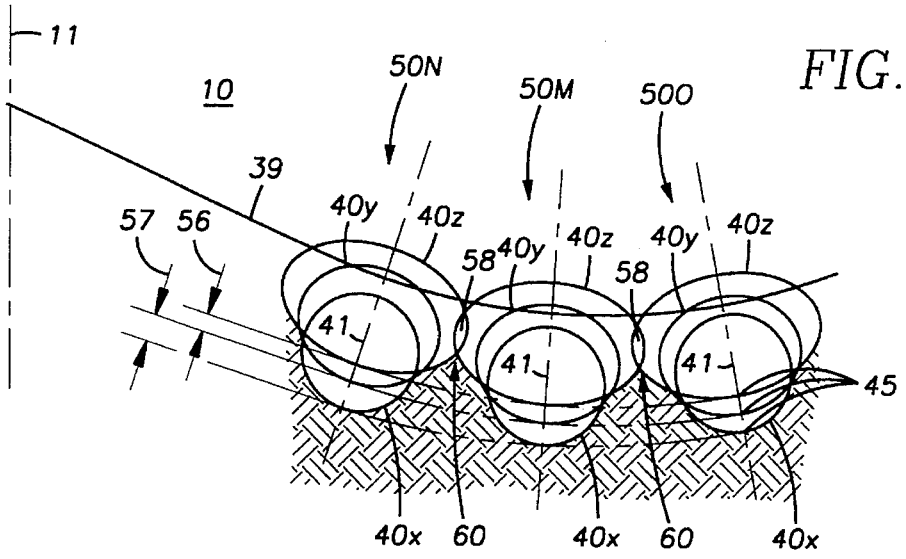

Another alternative embodiment of the invention is shown in FIG. 10. As shown therein, bit 10 includes a number of radially spaced cutter element sets 50N–O. Cutter elements 40 within the same set 50 have generally the same radial position with respect to bit axis 11 and have their element axes 41 aligned and normal to bit face 20. Elements 40 of sets 50 are mounted on blades 31–36 so as to have varying degrees of backrake. Elements 40 further vary in cutting profile size and are mounted at different exposure heights on the blade profiles 39 of bit face 20. The cutter elements 40 having the greatest exposure are identified by reference character 40x. The cutter elements having the least exposure are shown as elements 40z. Elements of intermediate exposure are identified by the reference character 40y. The exposure variance between element 40z and 40y is represented by reference numeral 56. The exposure variance between element 40y and 40x is shown by reference numeral 57. Although such variances may vary, variances 56 and 57 may be, for example, approximately 0.030 and 0.030 inches respectively for sets 50 located in the central portion 24 of the bit face 20. Once again, these variances 56 and 57 will decrease upon moving away from bit axis 11 toward gage surface 28.

As shown, elements 40x, *y* and *z* have substantially circular cutting faces 44 of different diameters and are mounted so as to have varying degrees of backrake. It is preferred that elements 40x be mounted so as to have a substantially 10° backrake, and that elements 40z have substantially a 30° backrake. In this embodiment, elements 40y are mounted so as to have approximately a 20° backrake. Due to elements 40x–40z having varying degrees of backrake, the cutting profile of elements 40z, in rotated profile, will be more elliptical than those of 40y, which, in turn, will be more elliptical than those of elements 40x which will appear only slightly elliptical. Ideally, the cutting face 44 of elements 40x should have the smallest diameter while elements 40z, which are positioned closest to the bit face 20 and have the smallest initial exposure to the formation have the largest diameter. As an example of acceptable cutter sizes, cutter elements 40x may have cutting faces having diameters of ¾ inch, with the cutting faces of cutter elements 40y and 40z having diameters of ⅝ inch and ½ inch, respectively. Additionally, cutter elements 40z in adjacent radially spaced sets 50 will be positioned such that their cutting face profiles overlap, so as to form a region 58 of double cutter density.

The elements 40x, *y* and *z* in each set 50 are divided among a number of blades 31–36 on bit face 20. Obviously, for a three element set 50 as shown in FIG. 10, bit 10 will require at least three blades. Because the cutting profiles of cutter elements 40z overlap radially and could therefor not be mounted in the same row 48 on the same blade, and so as to provide for more equal loading on all the blades, elements 40x–40z are divided among the blades. For example, a first blade 31 may include a row 48 having radially spaced elements 40z of cutter set 50N, 40y of set 50M, and 40x of set 500. The next blade 32 may include element 40x of set 50N, element 40z of set 50M and element 40y of set 50O. The third blade 33 would then include element 40y of set 50N, element 40x of set 50M and element 40z of set 50O.

The cutter element arrangement thus described and shown in rotated profile in FIG. 10 will cream relatively high ridges between the cutter sets 50 in the regions designated by reference numeral 60. These ridges will tend to be higher than those created by the cutting element arrangement previously described herein. The arrangement of elements 40 shown in FIG. 10 will tend to be highly resistant to lateral movement of the bit 10 due to the increased side loading from the ridges. The bit 10 will thus tend to remain stable and resist bit vibration. Additionally, the bit 10 of FIG. 10 exhibits increased penetration rates in varying formation hardnesses, the bit initially having the characteristics of a light set and later taking on those characteristics of a heavy set bit as the more exposed elements 40x, and later, 40y wear.

Although sets 50N–O are depicted in FIG. 10 as consisting of three elements 40 per set, the invention is in no way limited to any specific number of cutter elements 40 in a set 50. That is, a set 50 may include two, three or more elements 40 in the same set 50. Also, although each set 50 is shown in FIG. 10 to include an equal number of cutter elements 40, the number of cutter elements 40 in the sets may vary on the same bit. For example, it may be desirable to have a greater number of cutter elements 40 in a set 50 that is located at a particular radial position on the bit face 20 that is subjected to greater loading than a radial position that is not as highly loaded. Further, the degrees of backrake of the elements 40x, 40y, and 40z need not be 10°, 20° and 30° respectively, in every application. Also, sets 50 may include any desired number of redundant cutters in the positions shown by cutters 40x, 40y and 40z in FIG. 10, as previously described with respect to FIG. 5.

Figure 11:
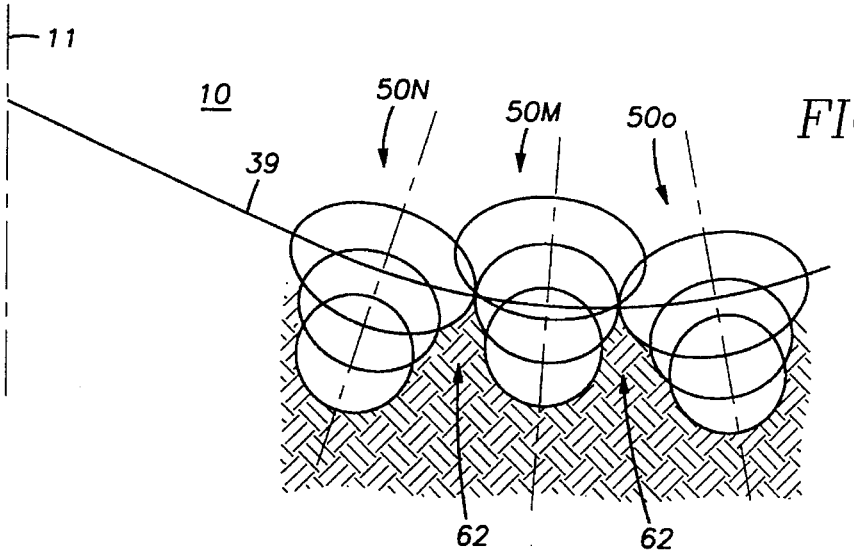
Figure 12:
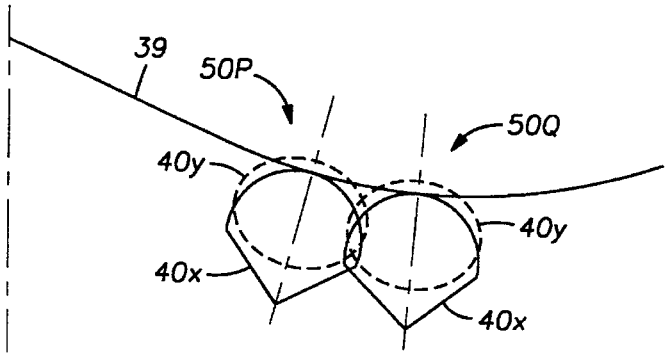

Still another alternative embodiment of the present invention is shown in FIG. 11. In this embodiment, radially adjacent cutter sets 50N–O themselves have varying degrees of exposure. More specifically, cutter elements 40x, *y* and *z* of sets 50N and 50O are mounted so as to protrude from the bit face 20 further into the formation material than the corresponding cutter elements of set 50M. This bit 10 produces even higher ridges of formation material in region 62 than the arrangement described with reference to FIG. 10. The ridges in region 62 between cutter sets 50 again produce increased side loading relative to conventional bits, thereby increasing the stability of the bit and resisting bit vibration.

Finally, although the preferred embodiments described herein have been depicted and described with reference to cutters 40 having circular cutting faces, it should be understood that the invention is not limited to cutters 40 having any particular shape of cutting profile. For example, referring to FIG. 12, a bit 10 structured in accordance with the present invention is shown with cutter sets 50P and 50Q in rotated profile. Each set includes a more highly exposed cutter element 40*x*, and a lesser exposed element 40*y*. Elements 40*x* are scribe cutters having cutting points or tips 45 and are mounted with backrake angles of substantially 10°. By contrast, elements 40*y* are round-faced cutters that are mounted at a less aggressive backrake angle of approximately 30°. Various other combinations of mounting height, cutter shape and backrake angles can be employed to enjoy the substantial benefits that are offered by the present invention.

While the preferred embodiments of the invention have been shown and described, modifications thereof can be made by one skilled in the art without departing from the spirit and teachings of the invention. The embodiments described herein are exemplary only, and are not limiting. Many variations and modifications of the invention and the principles disclosed herein are possible and are within the scope of the invention. Accordingly, the scope of protection is not limited by the description set out above, but is only limited by the claims which follow, that scope including all equivalents of the subject matter of the claims.

What is claimed is:

1. A cutting structure of a drill bit for cutting kerfs in formation material when the bit is rotated about its axis, said cutting structure comprising:

a set of spaced cutter elements mounted on the bit at substantially the same radial position relative to the bit axis such that each of said cutter elements in said set cuts in substantially the same kerf as the other cutter elements in said set when the bit is rotated about its axis; and wherein at least one of said cutter elements in said set is mounted with a backrake angle that differs from the backrake angle of other elements in said set.

2. The cutting structure of claim 1 wherein a first cutter element in said set is mounted such that its cutting profile is more exposed to the formation material than the cutting profile of a second of said elements in said set.

3. The cutting structure of claim 2 wherein said first and second cutter elements are mounted such that said first element has a backrake angle that is greater than the backrake angle of said second cutter element.

4. The cutting structure of claim 2 wherein said first and second cutter elements are mounted such that said first element has a backrake angle that is less than the backrake angle of said second cutter element.

5. The cutting structure of claim 1 wherein said cutter elements in said set have backrake angles that vary between approximately ten and approximately 30 degrees.

6. The cutting structure of claim 1 wherein said set includes a first plurality of cutter elements mounted at a first backrake angle and a second plurality of cutter elements mounted at a second backrake angle that differs from said first backrake angle; and wherein said cutter elements having said first backrake angle and said cutter elements having said second backrake angle are angularly spaced apart on the bit in alternating fashion.

7. The cutting structure of claim 1 wherein said cutter elements in said set have cutting profiles that differ in shape.

8. The cutting structure of claim 7 wherein a first cutter element in said set is mounted such that its cutting profile is more exposed to the formation material than the cutting profile of a second of said elements in said set.

9. The cutting structure of claim 8 wherein said first cutter element has a pointed cutting profile.

10. The cutting structure of claim 8 wherein said cutter elements in said set have backrake angles that vary between approximately ten and approximately 30 degrees.

11. A drill bit for drilling through formation material when said bit is rotated about its axis, said bit comprising:

a bit body;

a bit face on said body;

at least one set of cutter elements disposed on said bit face, said cutter element set including a first cutter element mounted at a first backrake angle and a second cutter element mounted at a second backrake angle that differs from said first backrake angle; and wherein said first and second cutter elements of said set are mounted in said bit face at generally common radial positions relative to the bit axis.

12. The drill bit of claim 11 wherein said first and second cutter elements have cutting faces that differ in shape.

13. The drill bit of claim 12 wherein said first cutter has a more aggressive backrake angle than the backrake angle of said second cutter element, and wherein the cutting profile of said first cutter element is pointed.

14. The drill bit of claim 11 wherein said first cutter element is mounted at a first exposure height for cutting a groove in the formation material of a first depth when said bit is rotated, and wherein said second cutter element is mounted at a second exposure height that is less than said first exposure height for cutting a groove in the formation material that has a depth less than said first depth.

15. The drill bit of claim 11 wherein said cutter elements are arranged on said bit face in angularly spaced rows of cutter elements, and wherein said cutter elements in said rows are radially spaced from each other relative to the bit axis, said rows including a plurality of said first cutter elements and a plurality of said second cutter elements.

16. The drill bit of claim 15 wherein at least one of said rows comprises a series of alternately positioned first cutter elements and second cutter elements.

17. The drill bit of claim 11 wherein said cutter element set further comprises a third cutter element mounted at a third backrake angle that differs from said first and second backrake angles, said third cutter element being mounted in said bit face at generally the same radial position relative to the bit axis as said first and second elements.

18. The drill bit of claim 17 wherein said third cutter element is mounted at an exposure height that differs from the exposure height of said first and second cutter elements in said set.

19. The drill bit of claim 11 wherein said first and second cutter elements of said set include generally circular cutting faces, and wherein said cutting face of said first cutter element is smaller in diameter than said cutting face of said second cutter element.

20. The drill bit of claim 11 wherein said set of cutter elements comprises at least three cutter elements mounted in said bit face at generally common radial positions relative to the bit axis and having cutting faces of unequal diameters, and wherein said cutter elements are mounted so that in rotated profile, said cutter element having the smallest cutting face is the most exposed to the formation material and said cutter element having the largest cutting face is the least exposed to the formation material.

21. The drill bit of claim 11 wherein said first and second cutter elements have PDC cutting faces, said cutting face of said first cutter element being larger in area than said cutting face of said second cutter element; and wherein said first cutter element is mounted at a backrake angle that is greater than the backrake angle of said second cutter element.

22. The drill bit of claim 11 wherein said first and second cutter elements have PDC cutting faces, said cutting face of said first cutter element being larger in area than said cutting face of said second cutter element; and wherein said first cutter element is mounted at a backrake angle that is less than the backrake angle of said second cutter element.

23. The drill bit of claim 14 wherein said bit comprises a plurality of sets of cutter elements wherein said cutter element sets are radially spaced from one another in rotated profile; and wherein the variance in exposure heights of said cutter elements in said sets differs among the sets of cutters across the bit face, said exposure variance being greater in the central portion of said bit face and decreasing upon moving from said central portion to the periphery of said bit face.

24. The drill bit of claim 14 wherein said bit comprises a plurality of sets of cutter elements wherein said cutter element sets are radially spaced from one another in rotated profile; and wherein the variance in exposure heights of said cutter elements in said sets is substantially the same across the bit face.

25. The drill bit of claim 11 wherein said cutter elements are arranged on said bit face in angularly spaced rows, and wherein said first cutter elements of said sets are mounted in a first of said rows, and wherein said second cutter elements of said sets are mounted in a second of said rows.

26. A fixed cutter drill bit for drilling through formation material when said bit is rotated about its axis, said bit comprising:

a bit body;

a bit face on said body, said bit face including a plurality of cutter elements mounted thereon and protruding therefrom, said cutter elements having cutting faces for cutting swaths through the formation material and being arranged in a plurality of cutter sets radially spaced from each other relative to the bit axis;

wherein said cutter sets comprise a plurality of angularly spaced cutter elements having element axes at generally common radial positions relative to the bit axis; and wherein said cutter elements of said sets are mounted on said bit face at varying backrake angles.

27. The drill bit of claim 26 wherein said cutter elements of said sets are mounted on said bit face in angularly spaced rows;

wherein a first of said rows comprises cutter elements having cutting faces mounted at a first backrake angle and wherein a second of said rows comprises cutter elements having cutting faces mounted at a second backrake angle that is less than said first backrake angle.

28. The drill bit of claim 26 wherein said cutter elements of said sets are mounted on said bit face in angularly spaced rows, at least one of said rows including cutter elements mounted at a first backrake angle and cutter elements mounted at a second backrake angle that is less than said first backrake angle.

29. The drill bit of claim 26 wherein said cutter elements of said sets are mounted on said bit face in angularly spaced rows; and wherein at least one of said rows include alternately positioned cutter elements mounted at said first and second backrake angles.

30. The drill bit of claim 26 wherein at least one of said sets includes a plurality of cutter elements mounted at a first backrake angle and a plurality of cutter elements mounted at a second backrake angle that is different from said first backrake angle; and wherein some of the plurality of cutter elements having said first backrake angle have cutting faces that differ in shape from the cutting faces of some of the plurality of cutter elements having said second backrake angle.

31. The drill bit of claim 26 wherein said cutting faces of said cutter elements in a given set have cutting faces that are generally circular in shape, and wherein said cutting faces have diameters that are not all the same.

32. The drill bit of claim 31 wherein said given set of cutter elements includes a first cutter element having a cutting face of a first diameter, and a second cutter element having a cutting face of a second diameter that is less than said first diameter; and wherein said second cutter element is mounted on said bit face so as to have a greater exposure to the formation material than said first cutter element.

33. The drill bit of claim 32 wherein said first and second cutter elements are mounted at backrake angles within the range of approximately 10° to approximately 30°.

34. A fixed cutter drill bit for drilling through formation material when said bit is rotated about its axis, said drill bit comprising:

a bit body including a bit face having at least one pair of radially disposed blades, each blade pair including a first blade and a second blade angularly spaced from said first blade;

cutter elements disposed in rows on said blades, each of said rows including cutter elements radially spaced from each other relative to the bit axis, said cutter elements in said rows having cutting faces for cutting formation material and an element axis that is normal to said bit face;

wherein said cutter elements in said rows are arranged in sets, each of said sets comprising a first cutter element on said first blade and a second cutter element on said second blade having element axes at generally common radial positions relative to the bit axis; and wherein said first cutter element is mounted at a first backrake angle and said second cutter element is mounted at a second backrake angle that is different from said first backrake angle.

35. The drill bit of claim 34 wherein said first cutter elements are mounted so as to be more exposed to the formation material than said second cutter elements.

36. The drill bit of claim 35 wherein said first cutter elements are mounted with more backrake than said second cutter elements.

37. The drill bit of claim 35 wherein said first cutter elements are mounted with less backrake than said second cutter elements.

38. The drill bit of claim 35 wherein said first and second cutter elements have generally circular cutting faces of substantially equal diameters.

39. The drill bit of claim 34 wherein said cutter elements in a set include cutting faces of relatively smaller and larger diameters, and wherein said cutter elements having said cutting faces of smaller diameter are mounted so as to be more exposed to the formation material than said cutter elements having said cutting faces of larger diameter.

40. The drill bit of claim 34 further comprising a third blade on said bit body and a third row of cutter elements mounted on said third blade; wherein said third row of cutter elements includes a third cutter element having an axis at a generally common radial position as said first and second cutter elements; and wherein said third cutter element is mounted at a third backrake angle that is different from said first and second backrake angles.

41. The drill bit of claim 34 wherein a given one of said rows comprises a first plurality of said first cutter elements and a second plurality of said second cutter elements.

42. The drill bit of claim 41 wherein said cutter elements are mounted in said given row in a repetitive pattern of first and second cutter elements.

43. The drill bit of claim 42 wherein said repetitive pattern comprises alternately positioned first and second cutter elements.

* * * * *